United States Patent [19]

Rohner

[11] 4,283,180

[45] Aug. 11, 1981

[54] BELT DRIVE FOR A WINDING MACHINE AND A PULLEY FOR GENERATING A PERIODICALLY CHANGING DRIVE SPEED

[76] Inventor: Friedbert Rohner, Kukenthalstrasse 12 a, D-8630 Coburg, Fed. Rep. of Germany

[21] Appl. No.: 39,140

[22] Filed: May 15, 1979

[30] Foreign Application Priority Data

Jul. 14, 1978 [DE] Fed. Rep. of Germany ..... 2830944

[51] Int. Cl.[3] ..... F16H 55/52

[52] U.S. Cl. ..... 474/8

[58] Field of Search ..... 74/217 CV, 230.17 R, 74/230.17 A, 230.17 B, 230.17 C, 230.17 D, 230.17 E, 230.17 F, 230.17 T, 230.17 P, 230.17 L, 230.17 M, 230.17 S; 474/8–10, 23

[56] References Cited

U.S. PATENT DOCUMENTS

| | | | |
|---|---|---|---|
| 3,365,967 | 1/1968 | Moogk | 74/230.17 A |
| 3,623,377 | 11/1971 | Lewis et al. | 74/230.17 E |
| 3,628,389 | 12/1971 | Wiegelmann et al. | 74/230.17 M |
| 3,747,721 | 7/1973 | Hoff | 74/230.17 S |
| 3,811,331 | 5/1974 | Moogk | 74/230.17 A |
| 4,173,155 | 11/1979 | Togami et al. | 74/230.17 M |

*Primary Examiner*—Lawrence J. Staab
*Attorney, Agent, or Firm*—Kenyon & Kenyon

[57] ABSTRACT

The pulley automatically changes drive speed by having a V-belt engaged at different diameters on the pulley discs. One disc is fixed to the shaft while the other disc is freely rotatable and axially slidable on the shaft. The discs have different cone angles to cause the V-belt to engage the cone surfaces at different diameters so as to cause the movable disc to rotate at a different speed from the fixed disc. A cone means is provided to reciprocate the movable disc during rotation under the bias of the V-belt.

10 Claims, 3 Drawing Figures

Figure 1:
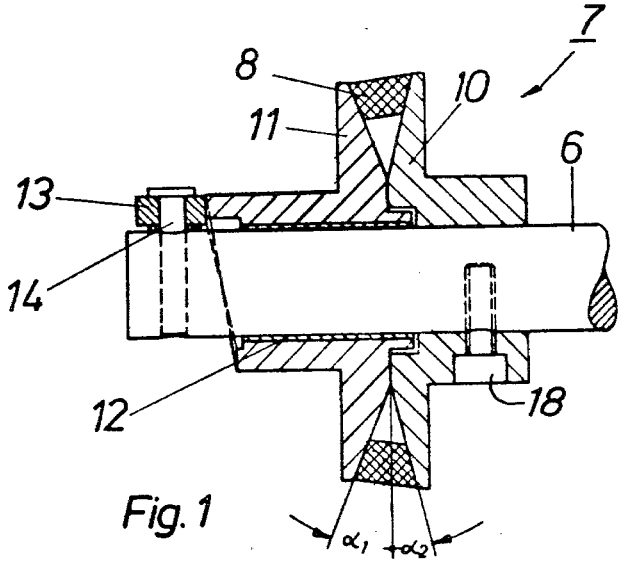

BELT DRIVE FOR A WINDING MACHINE AND A PULLEY FOR GENERATING A PERIODICALLY CHANGING DRIVE SPEED

This invention relates to a belt drive and a pulley for a winding machine. More particularly, this invention relates to a belt drive for a winding machine and a pulley for generating a periodically changing drive speed.

As is known, in order to take care of the so-called "random windings" being wound by winding machines, it has been necessary to periodically change the transmission ratio between a coil drive of constant speed—which is usually effected via a friction cylinder—and a drive of a laying unit so that no pattern or lap winding is produced in the coil.

While solutions to this problem have been known, such as described in German Pat. No. 1760524 and Swiss Pat. No. 134,580, the required expenditure of equipment and control means has been relatively large in both cases since an additional adjusting motion must be supplied continuously.

Accordingly, it is an object of the invention to provide a simple belt drive for a winding machine which is capable of generating a periodically changing drive speed.

It is another object of the invention to use a minimum of parts and control means in a belt drive for a winding machine in order to effect a periodically changing drive speed.

It is another object of the invention to provide a belt drive having a V-belt and a spring or weight-loaded compensation pulley which is capable of generating a periodically change drive speed in a relatively simple manner.

It is another object of the invention to provide a self adjusting pulley of relatively simple construction for generating a periodically changing drive speed.

Breifly, the invention provides a belt drive for a winding machine which is comprised of a rotatable output shaft, a V-shaped pulley belt for driving the shaft, and a divided self-adjusting pulley mounted on the shaft.

The pulley is constructed of a pair of discs one of which is fixed to the shaft for the rotation with the shaft while the other disc is mounted on the shaft for relative rotation with the shaft as well as for relative axial movement. The discs each have a conical surface on one side receiving an edge of the pulley belt and each conical surface is of a different angle from the other.

The belt drive also has a cam means for reciprocating the movable disc axially of the shaft during rotation of the shaft with the pulley engaged between the conical surfaces of the discs as well as a means for driving the belt to rotate the discs at a different speed relatively to each other.

In one embodiment, the cam means includes a roller mounted on the shaft and a cam surface on the movable disc in abutment with the roller. During rotation of the movable disc relative to the shaft, the roller causes reciprocation of the movable disc via the cam surface.

In another embodiment, the cam means includes a cupshaped member fitted over an end of the shaft with a cam surface facing one end of the movable disc, an annular groove in the end of the movable disc and a ball within the groove and abutting the cam surface to cause reciprocation of the movable disc relative to the shaft.

During operation, the belt serves to adjust the drive of the self-adjusting pulley quasi-automatically.

Figure 2:
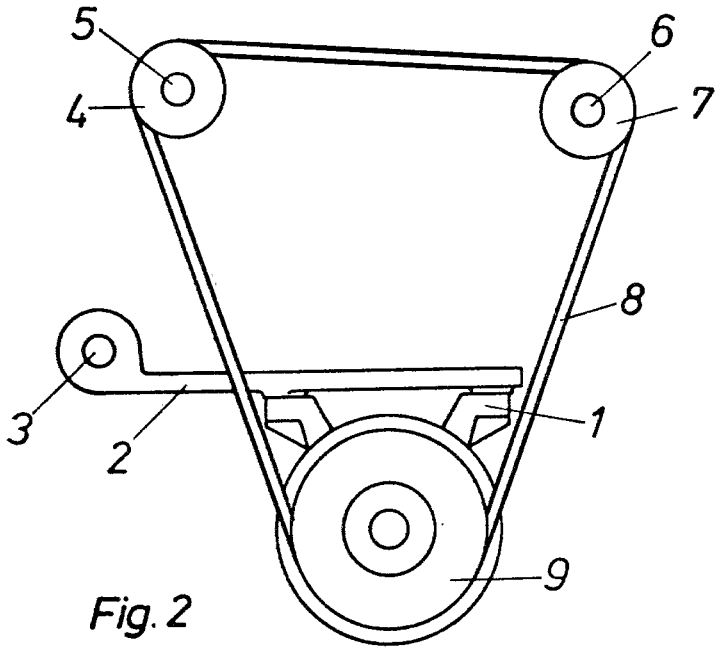
Figure 3:
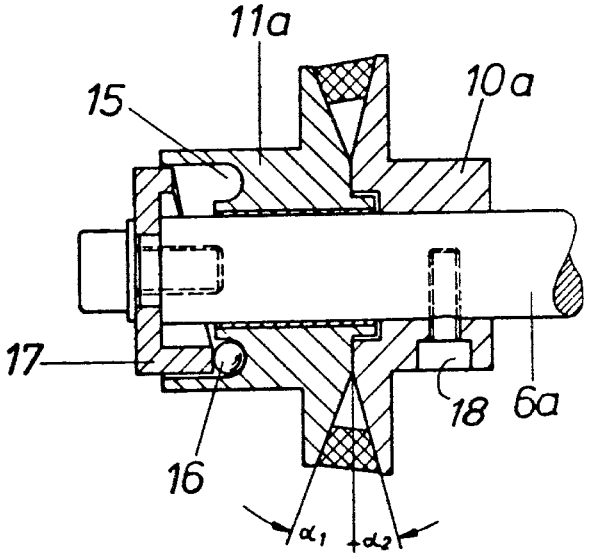

These and other objects and advantages of the invention will become more apparent from the following detailed description and appended claims taken in conjunction with the accompanying drawings in which:

FIG. 1 illustrates a cross-sectional view of a pulley constructed in accordance with the invention;

FIG. 2 diagrammatically illustrates a belt drive of a winding machine employing the pulley of FIG. 1; and FIG. 3 illustrates a cross-sectional view of a modified pulley in accordance with the invention.

Referring to FIG. 1, the belt drive for a winding machine includes a means such as a drive motor 1 having a drive pulley 9 for driving a V-shaped belt 8 about a pair of driven pulleys 4, 7.

As shown, the motor 1 is secured to a rocker arm 2 which is supported on a fulcrum 3 in the frame (not shown) of the winding machine so as to weight-bias the belt 8 radially into the pulleys 4, 7. The pulley 4 is mounted on a shaft 5 in common with a friction cylinder (not shown) for driving a coil while the pulley 7 is mounted on a shaft 6 which leads to a laying device (not shown).

Referring to FIG. 1, the pulley 7 is a divided self-adjusting pulley. To this end, the pulley 7 has a first disc 10 fixed to the shaft 6 via a bolt 18 for rotation therewith, which disc 10 has a conical or cone surface of a given angle $\alpha_2$ on one side to receive an edge of the pulley belt 8 thereon. The pulley 7 also has a second disc 11 mounted on the shaft 6 for free relative rotation therewith and for relative axial movement via a suitable bearing such as a bushing 12. This disc 11 which is freely rotatable has a conical surface on a side facing the fixed disc to receive an opposite edge of the pulley 8. This surface is of an angle $\alpha_1$ different from the angle $\alpha_2$ of the conical surface on the fixed disc 10.

The pulley 7 also has a cam means for reciprocating the movable disc axially of the shaft 6 during rotation of the shaft 6 with the belt engaged between the discs 10, 11. This cam means includes a roller 13 which is mounted on the shaft 6 via a bearing pin 14 for rotation with the shaft 6 about an axis perpendicular to the shaft 6 and an annular cam surface on the end of the disc 11 which is in abutment with the roller 13.

During operation, the weight of the motor provides the necessary tension for the V-belt 8 by biasing the belt 8 radially into the discs 10,11 of the pulley 7. Since the pulley 9 of the motor 1 forms a fixed transmission ratio with the pulley 4, the shaft 5 and therefore, the friction cylinder (not shown), runs at constant speed. The speed of the shaft 6, however, depends on the running diameter of the V-belt 8 within the pulley 7. This running diameter changes as follows:

Because of the different cone angles $\alpha_1$, $\alpha_2$, the taut V-belt assumes a slightly inclined position in the pulley 7. Only the fixed disc 10, which is connected to the shaft 6, serves for transmitting power; the adjustable disc 11 with the bushing 12 is braced via the cam at the end of the disc 11 against the roller 13. Because of the inclined position of the V-belt 8, the edge or flank of the belt 8 always rests against the fixed disc 10 on a larger radius than the belt edge or flank on the adjustable disc 11. This difference in the running of the belt 8 causes the movable disc 11 to lead the fixed disc 10 in each revolution of the shaft 6 by a small angle. This relative motion causes a simultaneous axial displacement of the adjustable disc 11 in accordance with the shape of the cam at the end of the disc 11. Thus, the V-belt 8 moves radially of the disks 10, 11 to another running diameter and thereby changes the speed of the shaft 6. The adjustment occurs periodically. The adjustment frequency is determined by the difference in the cone angles $\alpha_1$-$\alpha_2$, and the amplitude by the axial travel distance of the adjusting disc 11, i.e., by the slope of the cam surface.

During operation, the motor 1 thus serves as a means to drive the belt 8 to rotate the discs 10, 11 at a differential speed relative to each other.

Referring to FIG. 3, the pulley components which effectuate the axial motion may also be interchanged with respect to position. For example, the pulley may be constructed with a disc 10*a* fixed to a shaft 6*a* via a bolt 18, as above, and a movable disc 11*a* which is rotatable and axially slidable relative to the shaft 6*a*, as above. The discs 10*a*, 11*a*, as above, have cone surfaces with different angles $\alpha_1$, $\alpha_2$ from each other. In this case, the cam means for reciprocating the movable disc 11*a* includes a cup-shaped member 17 fitted over an end of the shaft 6*a* with an annular cam surface facing the end of the movable disc 11*a*. This member 17 is secured to the shaft 6*a* by a suitable washer and bolt assembly as shown. In addition, the cam means includes an annular groove 15 on the end of the movable disc 11*a* facing the member 17 and a ball 16 within the groove 15 abutting the cam surface on the member 17.

During rotation of the movable disc 11*a* relative to the shaft 6*a*, the ball 16 rolls along the groove 15 and cam surface on the member 17 to cause reciprocation of the movable disc 11*a*. In this regard, the biasing of the V-belt radially inwardly of the discs 10*a*, 11*a* biases the movable disc 11*a* and ball 16 towards and against the cam surface of the member 17.

What is claimed is:

1. A belt drive for a winding machine comprising a rotatable shaft;

a V-shaped pulley belt for driving said shaft;

a divided self-adjusting pulley mounted on said shaft, said pulley including a first disc fixed to said shaft for rotation therewith, said first disc having a conical surface of a given angle on one side receiving an edge of said pulley belt for rotation therewith and a second disc mounted on said shaft for free relative rotation therewtih and for relative axial movement, said second disc having a conical surface of an angle different from said given angle on a side facing said first disc receiving an opposite edge of said pulley belt for rotation therewith;

cam means for reciprocating said second disc axially to said shaft during relative rotation of said discs to move said belt radially of said discs and to change the speed of said shaft; and means for driving said belt to rotate said discs at a differential speed relative to each other.

2. A belt drive as set forth in claim 1 wherein said means for driving belt biases said belt radially inwardly of said discs.

3. A belt drive as set forth in claim 1 wherein said cam means includes a roller mounted on said shaft for rotation about an axis perpendicular to said shaft and a cam surface on an end of said second disc in abutment with said roller to cause reciprocation of said second disc during rotation of said second disc relative to said shaft.

4. A belt drive as set forth in claim 1 wherein said cam means includes a cup-shaped member fitted over an end of said shaft and having a cam surface facing one end of said second disc, an annular groove in said one end of said second disc, and a ball within said groove and abutting said cam surface to cause reciprocation of said second disc during rotation of said second disc relative to said shaft.

5. A self-adjusting pulley for mounting on and driving a rotatable shaft, said pulley comprising a first disc for fixed securement to the shaft for rotation therewith, said first disc having a conical surface of a given angle on one side to receive an edge of a pulley belt thereon;

a second disc for mounting on the shaft for free relative rotation therewith and for relative axial movement, said second disc having a conical surface of an angle different from said given angle on a side facing said first disc to receive an opposite edge of a pulley belt thereon; and cam means for reciprocating said second disc axially of the shaft during relative rotation to move a pulley belt radially of said discs to change the speed of the shaft.

6. A self-adjusting pulley as set forth in claim 5 wherein said cam means includes a roller for mounting on the shaft for rotation about an axis perpendicular to the shaft and a cam surface on an end of said second disc in abutment with said roller.

7. A self-adjusting pulley as set forth in claim 5 wherein said cam means includes a member for securement to the shaft and having a cam surface facing one end of said second disc, an annular groove in said one end of said second disc, and a ball within said groove and abutting said cam surface.

8. A self-adjusting pulley as set forth in claim 7 wherein said member is cup-shaped to fit over an end of said shaft.

9. A belt drive for a winding machine comprising a rotatable shaft;

a V-shaped pulley belt for driving said shaft;

a divided self-adjusting driven pulley mounted on said shaft, said driven pulley including a first disc fixed to said shaft for rotation therewith, said first disc having a conical surface of a given angle on one side receiving an edge of said pulley belt for rotation therewith, a second disc mounted on said shaft for free relative rotation therewith and for relative axial movement, said second disc having a conical surface of an angle different from said given angle on a side facing said first disc receiving an opposite edge of said pulley belt for rotation therewith;

cam means for reciprocating said second disc axially of said shaft during relative rotation of said discs; and a motor having a drive pulley receiving said pulley belt for driving said belt about said driven pulley to rotate said discs at a differential speed relative to each other, said motor biasing said belt radially inwardly of said discs to bias said second disc towards said cam means whereby during relative rotation of said discs, said second disc is displaced axially of said first disc to move said belt radially of said discs and to change the speed of said shaft.

10. A belt drive as set forth in claim 9 wherein said motor is supported on a fulcrum to weight-bias said belt radially inwardly of said discs.

* * * * *

UNITED STATES PATENT AND TRADEMARK OFFICE

CERTIFICATE OF CORRECTION

PATENT NO. : 4,283,180

DATED : August 11, 1981

INVENTOR(S) : Friedbert Rohner

It is certified that error appears in the above—identified patent and that said Letters Patent is hereby corrected as shown below:

Column 1, line 40, change "breifly" to --briefly"--

Column 1, line 56, after "different speed" change "relatively" to --relative--

Column 3, line 45, after "rotation" change "therewih" to --therewith--

Column 3, line 51, after "axially" on line 50, change "to" to --of--

Signed and Sealed this

Twenty-fourth Day of November 1981

[SEAL]

Attest:

GERALD J. MOSSINGHOFF

Attesting Officer

Commissioner of Patents and Trademarks